US007698756B1

(12) United States Patent
Chen

(10) Patent No.: US 7,698,756 B1
(45) **Date of Patent: *Apr. 20, 2010**

(54) SIMPLE AND STRONG FOLDABLE BED

(76) Inventor: Libin Chen, Qiaoyu building, West of Boyi Town, Changzhou, Jiangsu Province (CN) 213147

( * ) Notice: Subject to any disclaimer, the term of this patent is extended or adjusted under 35 U.S.C. 154(b) by 0 days.

This patent is subject to a terminal disclaimer.

(21) Appl. No.: 12/585,223

(22) Filed: Sep. 9, 2009

Related U.S. Application Data

(63) Continuation-in-part of application No. 12/382,700, filed on Mar. 23, 2009.

(51) Int. Cl.
*A47C 29/00* (2006.01)
*A47C 17/70* (2006.01)
*A47C 17/74* (2006.01)
*A47C 17/72* (2006.01)

(52) U.S. Cl. ..... 5/113; 135/96

(58) Field of Classification Search ..... 5/116, 5/117, 110–112, 115, 113, 174, 176.1, 182; 135/96

See application file for complete search history.

(56) References Cited

U.S. PATENT DOCUMENTS

| | | | | |
|---|---|---|---|---|
| 3,278,953 | A * | 10/1966 | Willis | 5/113 |
| 3,601,825 | A * | 8/1971 | Moorhead et al. | 5/110 |
| 3,619,827 | A * | 11/1971 | Mackenzie | 5/113 |
| 3,848,279 | A * | 11/1974 | Ipen, Jr. | 5/113 |
| 6,446,282 | B1 * | 9/2002 | Wu | 5/115 |
| 6,581,223 | B1 * | 6/2003 | Wang | 5/174 |
| 6,618,879 | B1 * | 9/2003 | Wu | 5/111 |
| 2009/0139026 | A1 * | 6/2009 | Chen | 5/111 |

* cited by examiner

*Primary Examiner*—Alexander Grosz

(57) ABSTRACT

A stronger foldable bed having a frame and a foldably soft cover attached thereto. The frame has two pairs of side bars each pivotally connected to a central link, a tilt leg pivotally connected to a free end of each side bar, three pairs of scissoring end or middle bars linking the two pairs of side bars, a pair of middle leg each containing a telescoping leg, a reinforcing bar each pivotally connected to one side bar and a sleeve covering on each tilt leg, and a journey limit formed on each tilt leg. The foldable bed is longitudinal stable, simple and strong, without sacrificing the easiness of operation of folding and expanding. The foldable bed has a tent attached thereto with the aid of slide fasteners.

3 Claims, 4 Drawing Sheets

SIMPLE AND STRONG FOLDABLE BED

CROSS-REFERENCE TO RELATED APPLICATIONS

This is a Continuation-in-part (CIP) application of a U.S. patent application Ser. No. 12/382,700, Filed Mar. 23, 2009.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to a foldable bed, and more particularly, to a foldable bed with a simple yet strong structure which is able to be folded and expanded easily.

2. Description of Related Art

Shown in FIG. 1 is a conventional foldable bed 8. It has a foldable frame 81 and a soft cover 82 securely attached to the frame 81. The foldable frame has a pair of middle legs 83, and two pairs of end legs 84, 85. One problem of such foldable bed is a longitudinally sway in direction A and B of the frame since the pairs of end legs 84, 85 lack of a longitudinal reinforcing mechanism. Other conventional foldable beds are either longitudinally unstable or complex in structure. Thus, it is desirable that there is provided a simple yet strong foldable bed without sacrificing the easiness of operation of folding and expanding.

BRIEF SUMMARY OF THE INVENTION

The main object of the invention is to provide a longitudinal stable foldable bed with simple yet strong structure but without sacrificing the easiness of operation of folding and expanding.

In order to accomplish the above objects, the present invention provides a foldable bed having a frame having:

- a first left side beam and a second left side beam pivotally connected to a left central link,
- a first right side beam and a second right side beam pivotally connected to a right central link,
- a tilt leg being respectively tilt to a free end of each the side beam and pivotally connected to each side beam near a free end of each side beam,
- a first end bar pivotally connected to a free end of the first left side beam at one end thereof and to a free end of the tilt leg of an opposite side at a free end thereof,
- an opposite first end bar pivotally connected to a free end of the first right side beam at one end thereof and to a free end of the tilt leg at a free end thereof, the first and the opposite first end bars being hinged at about middle portions hereof and able to scissor with respect to each other,
- a second end bar being pivotally connected to a free end of the second left side beam at one end thereof and to a free end of the tilt leg of an opposite side at a free end thereof,
- an opposite second end bar being pivotally connected to a free end of the second right side beam at one end thereof and to a free end of the tilt leg at a free end thereof, the first and the opposite second end bars being hinged at about middle portions hereof and able to scissor with respect to each other, a sleeve covering on and being slidable with respect to each the tilt leg,
- a reinforcing bar pivotally connected to each the sleeve at one end thereof and to the side beam at a free end thereof at a position where between each the tilt leg and each the end bar being connected to each the side beam,
- a journey limit securely formed on each the tilt leg under each the sleeve,
- a middle leg of shape of a tube and fixed to each the central link,
- a telescoping leg contained in each of the middle leg,
- a foot installed at a free end of each the telescoping leg,
- a middle bar pivotally connected to the left central link at one end thereof and to the foot of an opposite side at a free end thereof, and,
- an opposite middle bar pivotally connected to the right central link at one end thereof and to the foot at a free end thereof, the middle bars being hinged at about the middle portion thereof and able to scissor with respect to each other; and,
- a cover attached to the frame.

These and other objectives, features, and advantages of the present invention will become apparent from the following detailed description, the accompanying drawings, and the appended claims.

DETAILED DESCRIPTION OF THE INVENTION

Figure 1:
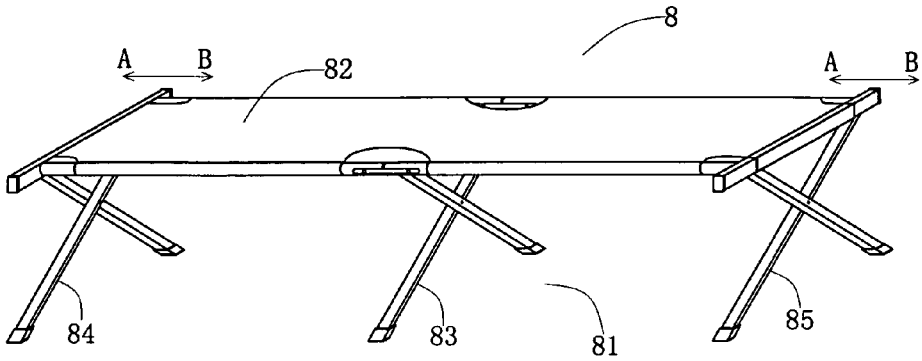
PRIOR ART FIG. 1
FIG. 1 is a perspective view showing a conventional foldable bed.
Figure 2:
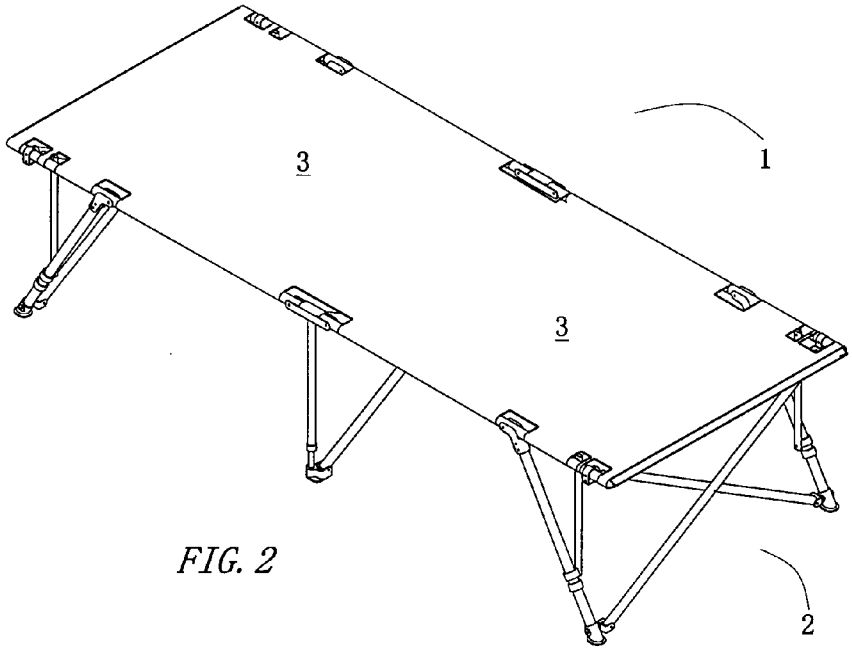
FIG. 2 is a schematic perspective view showing the preferred embodiment of the foldable bed of the invention.

With reference to FIG. 2, a perspective view of the preferred embodiment of a foldable bed 1 of the invention is shown. The foldable bed 1 is in a status of being expanded. The foldable bed 1 has a frame 2 and a soft cover 3 attached to the frame 2. The cover 3 is foldably soft and so strong as being able to act as a bedplate when the foldable bed 1 is expanded.

Figure 3:
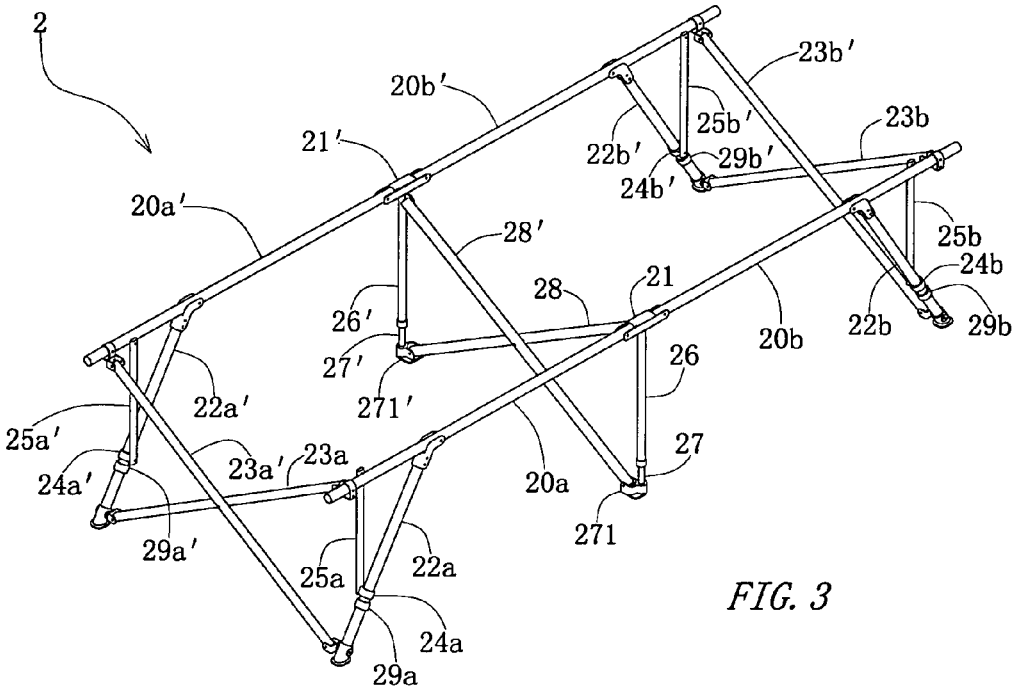
FIG. 3 is a schematic perspective view showing the foldable bed shown in FIG. 2 with a soft cover thereof being removed.

As particularly shown in FIG. 3, the frame 2 has a first left side beam 20*a* and a second left side beam 20*b* pivotally connected to a left central link 21, and a first right side beam 20*a*' and a second right side beam 20*b*' pivotally connected to a right central link 21'.

A tilt leg 22*a*, 22*a*', 22*b*, or 22*b*', which is respectively tilt to a free end of each side beam 20*a*, 20*a*', 20*b* or 20*b*', is pivotally connected to each side beam 20*a*, 20*a*', 20*b* or 20*b*' near a free end of each side beam 20*a*, 20*a*', 20*b* or 20*b*'.

A first end bar 23*a* is pivotally connected to a free end of the first left side beam 20*a* at one end thereof and to a free end of the tilt leg 22*a*' of an opposite side at a free end thereof. An opposite first end bar 23*a*' is pivotally connected to a free end of the first right side beam 20*a*' at one end thereof and to a free end of the tilt leg 22*a* at a free end thereof. The first and the opposite first end bars 23*a*, 23*a*' are hinged at about the middle portion hereof and able to scissor with respect to each other. A second end bar 23*b* is pivotally connected to a free end of the second left side beam 20*b* at one end thereof and to a free end of the tilt leg 22*b*' of an opposite side at a free end thereof. An opposite second end bar 23*b*' is pivotally connected to a free end of the second right side beam 20*b*' at one end thereof and to a free end of the tilt leg 22*b* at a free end thereof. The first and the opposite second end bars 23*b*, 23*b*' are hinged at about the middle portion hereof and able to scissor with respect to each other.

A sleeve 24*a*, 24*a*', 24*b*, or 24*b*' is provided covering on and being slidable with respect to each tilt leg 22*a*, 22*a*', 22*b*, or 22*b*'. A reinforcing bar 25*a*, 25*a*', 25*b*, or 25*b*' is pivotally connected to each sleeve 24*a*, 24*a*', 24*b*, or 24*b*' at one end thereof and to the side beam 20*a*, 20*a*', 20*b*, or 20*b*' at a free end thereof at a position where between each tilt leg 22*a*, 22*a*', 22*b*, or 22*b*' and each end bar 23*a*, 23*a*', 23*b*, or 23*b*' being connected to each side beam 20*a*, 20*a*', 20*b*, or 20*b*'. A journey limit 29*a*, 29*a*', 29*b*, or 29*b*' is securely formed on each tilt leg 22*a*, 22*a*', 22*b*, or 22*b*' under each sleeve 24*a*, 24*a*', 24*b*, or 24*b*' for blocking an over downward movement of each sleeve 24*a*, 24*a*', 24*b*, or 24*b*'.

A middle leg 26 or 26' is fixed to each central link 21 or 21'. Each middle leg 26 or 26' is of a shape of a tube and contains a telescoping leg 27 or 27' therein. A foot 271 or 271' is installed at a free end of each telescoping leg 27, 27'. A middle bar 28 is pivotally connected to the left central link 21 at one end thereof and to the foot 271' of an opposite side at a free end thereof. An opposite middle bar 28' is pivotally connected to the right central link 21' at one end thereof and to the foot 271 at a free end thereof. The middle bars 28, 28' are hinged at about the middle portion thereof and able to scissor with respect to each other.

Figure 4A:
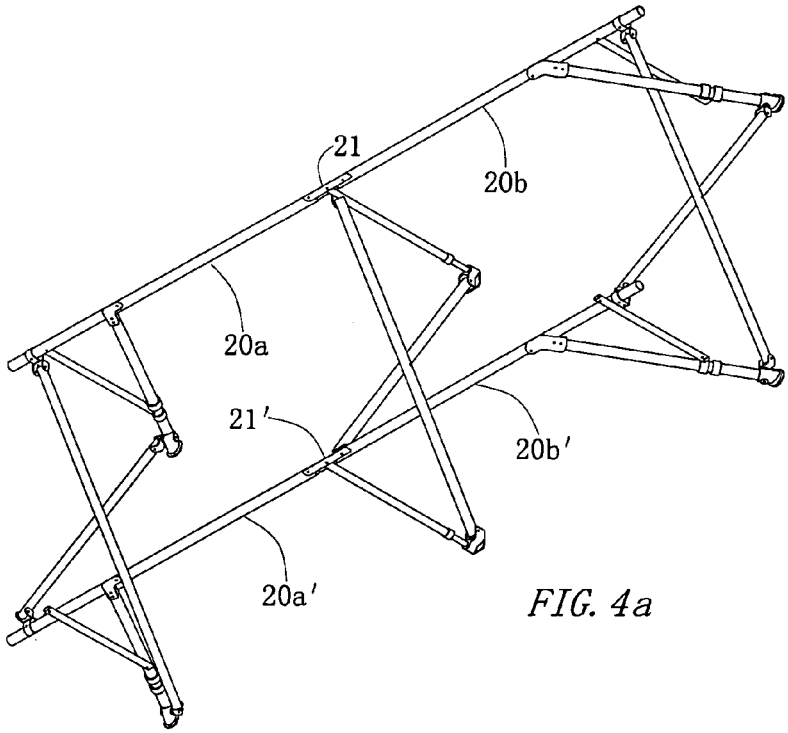
FIGS. 4*a* to 4*c* is schematic views showing an operation of folding of the foldable bed shown in FIGS. 2 and 3. And, FIG. 5 is a schematic perspective view showing another embodiment of the invention.
Figure 4B:
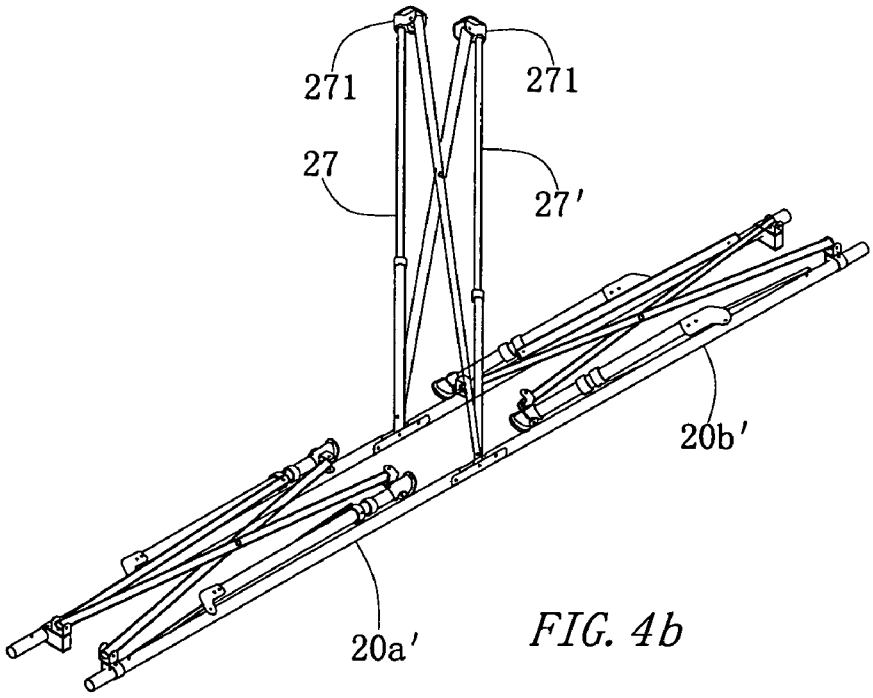
Figure 4C:
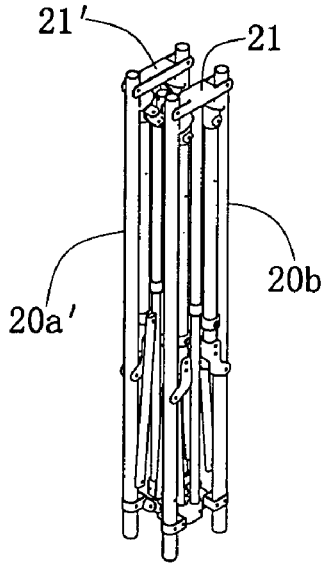

An operation of folding the foldable bed 1 of the invention is as shown in FIGS. 4*a* to 4*c*. For better illustration of movement of the frame 2, the soft cover 3, which will affect the operation of folding and expanding slightly, is not shown in these FIGs. With reference to FIG. 4*a*, in folding the foldable bed 1, a user is able to move the left side beams 20*a* and 20*b* towards the right side beams 20*a*' and 20*b*'. He may do this by either pulling the left and right central links 21 and 21' towards each other with hands, or over turning the foldable bed 1 with the right side thereof laying on a floor and then pushing the left side thereof downward to the floor.

In whichever way, when the left side beams 20*a* and 20*b* move towards the right side beams 20*a*' and 20*b*', each pair of end bars 23*a* and 23*a*', 23*b* and 23*b*', and the middle bars 28 and 28' scissor upward. Each tilt leg 22*a*, 22*a*', 22*b*, or 22*b*' will rotate towards the side beam 20*a*, 20*a*', 20*b*, or 20*b*' it pivotally connected to, and each sleeve 24*a*, 24*a*', 24*b*, or 24*b*' will go upward toward each side beam 20*a*, 20*a*', 20*b*, or 20*b*'. Meanwhile, the telescoping legs 27, 27' are pulled outward from the middle legs 26 or 26'. As shown in FIG. 4*b*, as the left side beams 20*a* and 20*b* arrive at a closest position to the right side beams 20*a*' and 20*b*', each tilt leg 22*a*, 22*a*', 22*b*, or 22*b*' will arrive at a closest position to each side beam 20*a*, 20*a*', 20*b*, or 20*b*' it linked. Then the user is able to fold the side beams 20*a*, 20*a*', 20*b*, or 20*b*' towards the middle legs 26, 26', to complete the operation of folding. A folded foldable bed 1 is as shown in FIG. 4*c*. A contrary operation may expand the foldable bed 1 of the invention for use.

Figure 5:
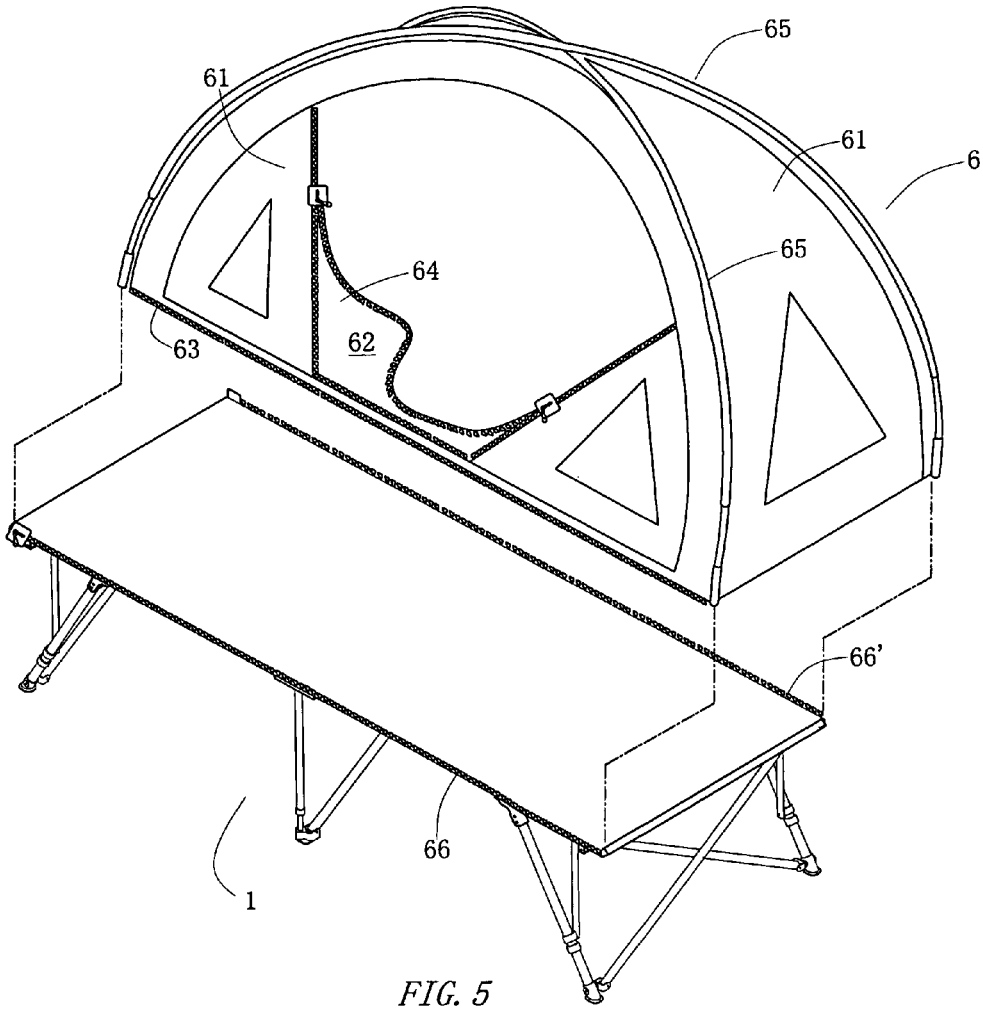

With reference to FIG. 5, a tent 6 is able to be detachably attached to the foldable bed 1. The tent 6 has a fabric body 61 with a floor 62, two parallel side 63, at least one access opening 64, and a supporting frame 65. In the embodiment shown in FIG. 5, the tent 6 is attached to the foldable bed 1 with two slide fasteners 66 and 66' respectively sewn to each of the two parallel side 63. The tent 6 is able to be detachably attached to the foldable bed 1 in other ways such as buttons, Velcro tapes, or laces.

From above description, it is seen that the objects of the present invention have been fully and effectively accomplished. Embodiment of the invention has been shown and described for the purposes of illustrating the functional and structural principles of the present invention and is subject to change without departure from the invention's principles. Therefore, this invention includes all modifications encompassed within the spirit and scope of the following claims.

The invention claimed is:

1. A foldable bed comprising:

a frame having:

a first left side beam and a second left side beam pivotally connected to a left central link, a first right side beam and a second right side beam pivotally connected to a right central link, a tilt leg being respectively tilt to a free end of each said side beam and pivotally connected to each said side beam near a free end of each said side beam, a first end bar pivotally connected to a free end of said first left side beam at one end thereof and to a free end of a tilt leg of an opposite side at a free end thereof, an opposite first end bar pivotally connected to a free end of said first right side beam at one end thereof and to a free end of a tilt leg at a free end thereof, a first and said opposite first end bars being hinged at about middle portions hereof and able to scissor with respect to each other, a second end bar being pivotally connected to a free end of said second left side beam at one end thereof and to a free end of a tilt leg of an opposite side at a free end thereof, an opposite second end bar being pivotally connected to a free end of said second right side beam at one end thereof and to a free end of a tilt leg at a free end thereof, said first and said opposite second end bars being hinged at about middle portions hereof and able to scissor with respect to each other, a sleeve covering on and being slidable with respect to each said tilt leg, a reinforcing bar pivotally connected to each said sleeve at one end thereof and to a side beam at a free end thereof at a position between where a tilt leg and an end bar are connected to a said side beam, a journey limit securely formed on each said tilt leg under each said sleeve, a middle leg of shape of a tube and fixed to each said central link, a telescoping leg contained in each of said middle leg, a foot installed at a free end of each said telescoping leg, a middle bar pivotally connected to said left central link at one end thereof and to a foot of an opposite side at a free end thereof, and, an opposite middle bar pivotally connected to said right central link at one end thereof and to a foot at a free end thereof, a middle bars being hinged at about the middle portion thereof and able to scissor with respect to each other; and, a cover attached to said frame.

2. The foldable bed as claimed in claim 1, wherein said foldable bed further has a tent detachably attached thereto.

3. The foldable bed as claimed in claim 2, wherein said tent is detachably attached to said foldable bed with slide fasteners.

* * * * *